US007296731B2

(12) United States Patent
Auclair et al.

(10) Patent No.: US 7,296,731 B2
(45) Date of Patent: Nov. 20, 2007

(54) CARTON WITH REMOVABLE CORNER PORTION

(75) Inventors: Jean Michel Auclair, Chateuroux (FR); Diego Rovere, Sao Paulo (BR); Patrick Blin, Chateauroux (FR); John Holley, Jr., Lawrenceville, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 213 days.

(21) Appl. No.: 10/794,742

(22) Filed: Mar. 5, 2004

(65) Prior Publication Data

US 2005/0194430 A1 Sep. 8, 2005

(51) Int. Cl.
*B65D 17/00* (2006.01)

(52) U.S. Cl. ..... 229/242; 206/427; 221/302; 221/305; 229/218

(58) Field of Classification Search ..... 229/120.03, 229/120.38, 240, 241, 242, 218, 122.1; 206/427; 221/302, 305
See application file for complete search history.

(56) References Cited

U.S. PATENT DOCUMENTS

| | | | | |
|---|---|---|---|---|
| 2,974,846 | A | 3/1961 | Struble | |
| 3,161,336 | A * | 12/1964 | Loescher | 229/242 |
| 3,178,242 | A * | 4/1965 | Ellis et al. | 229/122.1 |
| 3,517,858 | A | 6/1970 | Farquhar | |
| 3,533,549 | A * | 10/1970 | Gilchrist | 229/242 |
| 4,170,325 | A * | 10/1979 | Pawlowski et al. | 229/122.1 |
| 4,235,158 | A * | 11/1980 | Johnson, Jr. | 229/120.38 |
| 4,375,258 | A * | 3/1983 | Crayne et al. | 206/427 |
| 5,048,690 | A | 9/1991 | Zimmerman | |
| 5,193,712 | A * | 3/1993 | Kuppersbusch | 229/218 |
| 5,344,066 | A | 9/1994 | Fogle | |
| 5,368,194 | A | 11/1994 | Oliff et al. | |
| 5,505,372 | A * | 4/1996 | Edson et al. | 229/242 |
| 6,253,930 | B1 * | 7/2001 | Freidus et al. | 229/122.1 |
| 6,484,903 | B2 * | 11/2002 | Spivey et al. | 229/122.1 |
| 6,866,185 | B2 * | 3/2005 | Harrelson | 221/305 |
| 6,902,104 | B2 * | 6/2005 | Holley et al. | 229/242 |
| 6,918,487 | B2 * | 7/2005 | Harrelson | 206/427 |
| 6,959,857 | B2 * | 11/2005 | Bates | 229/122.1 |
| 6,974,072 | B2 * | 12/2005 | Harrelson | 229/122.1 |
| 7,093,713 | B2 * | 8/2006 | Sutherland | 206/427 |
| 2002/0070145 | A1 | 6/2002 | Yuhas et al. | |
| 2006/0091192 | A1 * | 5/2006 | Coltri-Johnson | 229/122 |

FOREIGN PATENT DOCUMENTS

| | | |
|---|---|---|
| EP | 1 398 275 | 3/2004 |
| GB | 2 300 853 | 11/1996 |
| JP | 2001-114260 | 4/2001 |
| WO | 97/21607 | 6/1997 |

* cited by examiner

*Primary Examiner*—Gary E Elkins
(74) *Attorney, Agent, or Firm*—Tsugihiko Suzuki

(57) ABSTRACT

A carton having a dispensing feature adapted for permitting the removal of articles from within the carton. To erect the carton, a plurality of panels are connected together to define an end of the carton. At least one removable portion is provided in the erected carton and is defined by an endless tear line. The endless tear line includes multiple portions defined in the top wall, one side wall, and end flaps extending from the top wall and the one side wall.

26 Claims, 14 Drawing Sheets

CARTON WITH REMOVABLE CORNER PORTION

TECHNICAL FIELD

The present invention relates generally to paperboard cartons for use in packaging articles and, more particularly, relates to a dispensing carton with at least one opening for dispensing articles from within the carton.

BACKGROUND OF THE INVENTION

Cartons are useful for allowing consumers to purchase, transport and store a desired quantity of articles such as soft drinks. For the convenience of the consumer, some cartons have dispensers which allow the articles to be removed one at a time while continuing to encase the remaining articles. A portion of the carton is torn out to form an opening from which articles may be dispensed. There are typically multiple rows of articles, one above the other, carried within the carton. Once the endmost article is removed from the carton through the dispenser, another article moves forward.

There are also larger cartons for multiple tiers of articles, one alongside the other, while each tier has multiple rows of articles, one above the other. These larger cartons are commonly referred to as double stacked cartons.

Although there are multiple types of cartons available, there is not a simple dispenser configuration that may be easily incorporated into most types of cartons as well as permit most types of articles to be easily dispensed. Therefore, there is a need for an improved dispenser that facilitates easy access to the endmost article within many types of cartons. The improved dispenser must be adaptable for use with double stack cartons.

SUMMARY OF THE INVENTION

The present invention provides a carton with an improved article dispenser defined by an endless tear line which facilitates easy access to the articles within various types of cartons. The improved article dispenser may be utilized to dispense various types of articles such as elongated bottles. The improved article dispenser is also adaptable for use with double stack cartons.

Generally described, a plurality of panels are connected together to form a tubular body for accumulating a plurality of articles. A pair of end closure structures at least partially close the opposite ends of the tubular body to form the carton. An article dispenser is provided in the carton by a removable portion defined by an endless tear line. The endless tear line is defined by multiple portions. A first portion formed in the top wall of the carton extends between an end edge and a side edge of the top wall. A second portion formed in one of the side walls extends from the side edge of the top wall to an end edge of the side wall. A third portion formed in one of the end closure structures extends between the end edge of the top wall and the end edge of the side wall.

According to one aspect of the present invention, a second article dispenser may be provided by a second removable portion positioned along side the first article dispenser. The second removable portion is defined by a second endless tear line in the carton. The first and second article dispensers of the present invention are particularly useful with double stack cartons.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION OF THE INVENTION

Figure 1:
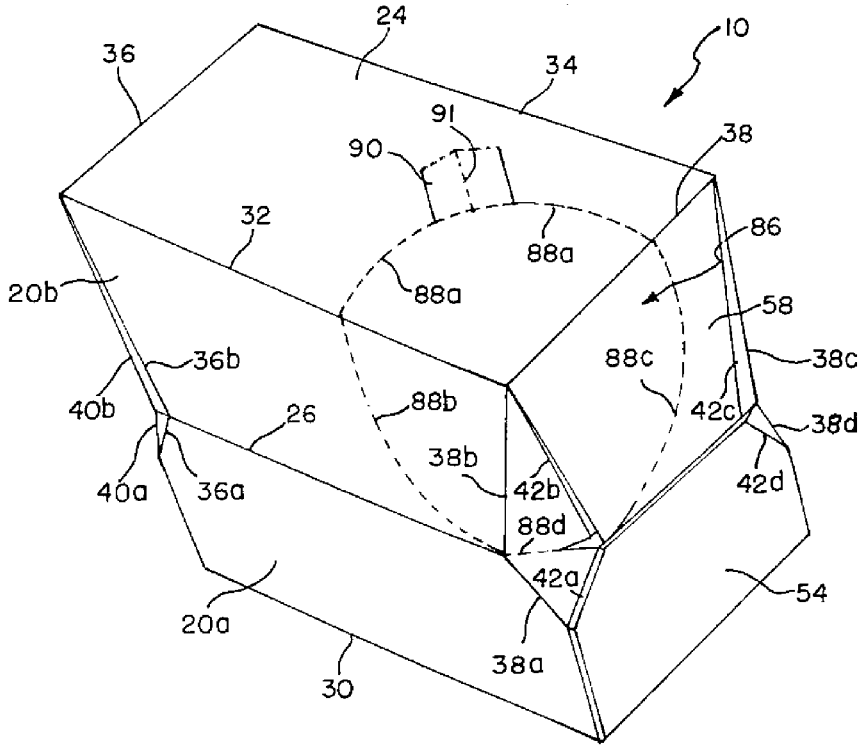
FIG. 1 illustrates a perspective view of a carton of a first embodiment according to the present invention.

Referring now to the drawings in which like numerals indicate like elements throughout the several views, the drawings illustrate exemplary embodiments of cartons 10 (FIG. 1), 12 (FIG. 7), and 14 (FIG. 12) of the present invention. In some embodiments, the cartons 10, 12 and 14 are for dispensing articles such as beverage cans or bottles.

Generally described, the cartons 10, 12 and 14 are formed from a foldable sheet material such as a paperboard. Carton 10, shown in FIG. 1, is formed from a paperboard blank 16 shown in FIG. 2. The blank 16 includes at least four primary panels for forming the carton 10. The panels of the blank 16 are a bottom wall 18, a first side wall 20, a second side wall 22, and a top wall 24. The first side wall 20 is divided by fold line 26 to define portions 20*a* and 20*b*. The second side wall 22 is divided by fold line 28 to define portions 22*a* and 22*b*. The side walls 20 and 22 have fold lines 26 and 28, respectively, so that the side walls 20 and 22 may be only slightly folded to erect the carton 10 as shown in FIGS. 1.

Figure 2:
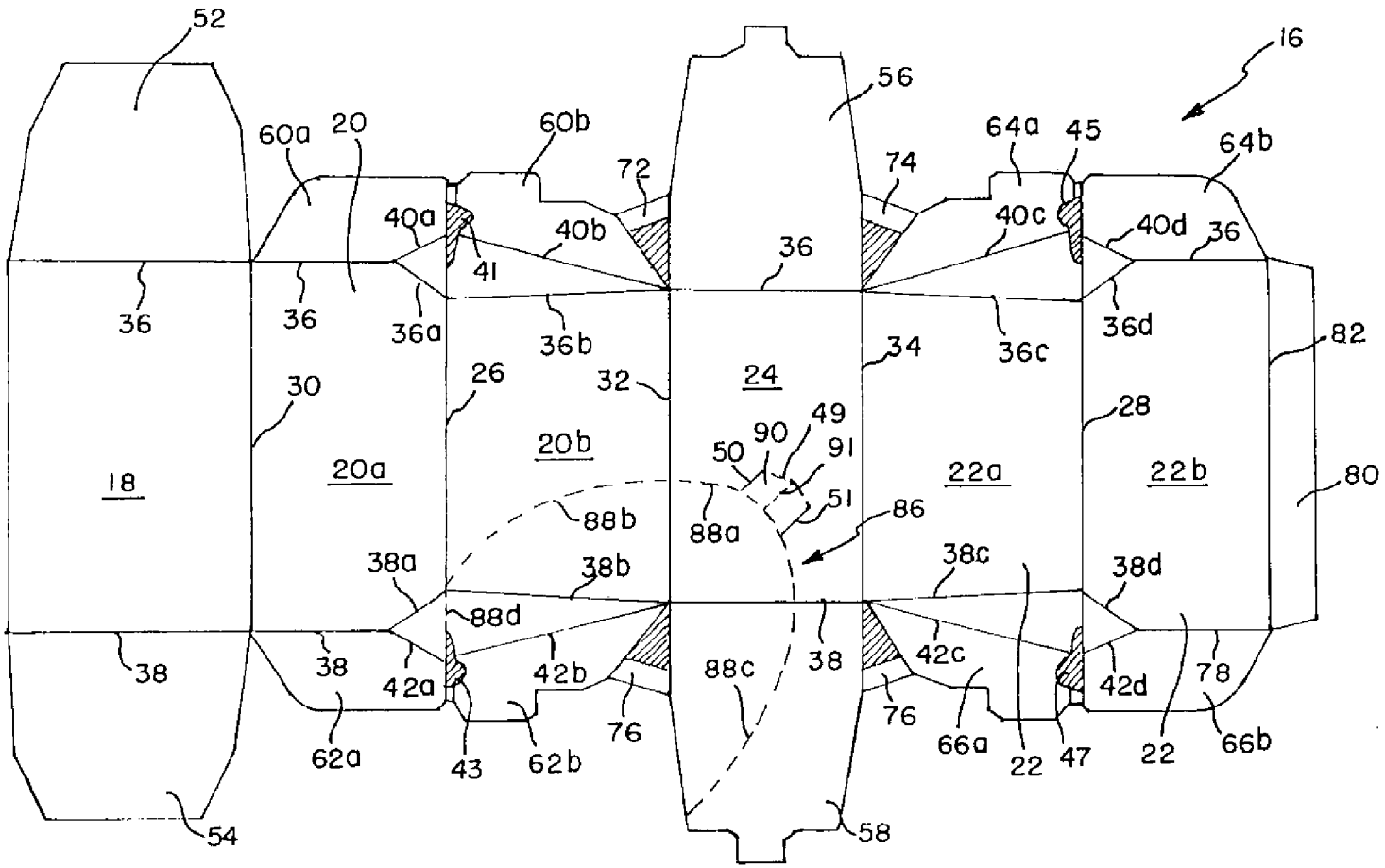
FIG. 2 illustrates a plan view of a blank for forming the carton of FIG. 1.

As shown in FIG. 2, the panels of the blank 16 are hingedly connected in series to one another along fold lines 30, 32 and 34. The bottom wall 18 is hingedly connected to the first side wall 20 by fold line 30. The first side wall 20 is then hingedly connected to the top wall 24 by fold line 32. The second side wall 22 is then hingedly connected to the top wall 24 by fold line 34.

Preferably, the width of the top wall 24 is smaller than the width of the bottom wall 18 as shown in FIG. 2. Because the top wall 24 is narrower than the bottom wall 18, the erected carton 10 is somewhat tapered above the fold lines 26, 28 on side walls 20, 22 as best shown in an end view (FIG. 5) of the erected carton 10.

Each of the panels 18, 20, 22 and 24 is provided with opposing end flaps hingedly connected to the respective panel along transverse fold lines 36 and 38. Fold lines 26 and 28 each extend the full width of the blank 16. However, fold lines 36 and 38 preferably do not extend straight all the way along the length of the blank 16. As shown in FIG. 2, the part of the fold line 36 defining one end edge of first side wall 20 includes portions 36*a* and 36*b* while the part of the fold line 38 defining the other end edge of first side wall 20 includes portions 38*a* and 38*b*. Portions 36*a* and 38*a* partially define the opposed end edges of portion 20*a* of the first side wall 20. Portions 36*b* and 38*b* define the opposed end edges of portion 20*b* of the first side wall 20. The part of the fold line 36 defining one end edge of second side wall 22 includes portions 36*c* and 36*d*, and the part of the fold line 38 defining the other end edge of second side wall 22 includes portions 38*c* and 38*d*. Portions 36*c* and 38*c* define the opposed end edges of portion 22*a* of the second side wall 22. Portions 36*d* and 38*d* partially define the opposed end edges of portion 22*b* of the second side wall 22.

The bottom wall 18 is provided with opposing bottom end flaps 52 and 54, and the top wall 24 is provided with opposing top end flaps 56 and 58. First side wall 20 is provided with opposing side end flaps 60 and 62. Second side wall 22 is provided with opposing side end flaps 64 and 66. The end flaps 52, 56, 60 and 64 extend outward from the transverse fold line 36. The end flaps 54, 58, 62 and 66 extend outward from the transverse fold line 38.

Still referring to FIG. 2, the end flaps 60, 62, 64, 66 of the first and second side walls 20, 22 include additional fold lines that cooperate with the transverse fold lines 36 and 38 to truncate the vertical corner edges of the carton 10 when erected. Fold line portion 40*a* is formed in the side end flap portion 60*a* and extends from one end of fold line portion 36*a* to a first cut out 41. Fold line portion 40*b* extends across side end flap portion 60*b* from fold line 32 and terminates at first cutout 41. The first cutout 41 is formed in the side end flap portion 60*b* in the manner to interrupt the fold line 26 and positioned between the fold line portions 40*a* and 40*b* to separate the portions 40*a* and 40*b*. Fold line portion 42*a* is formed in the side end flap portion 62*a* and extends from one end of fold line portion 38*a* to a second cutout 43. Fold line portion 42*b* extends across side end flap portion 62*b* from fold line 32 and terminates at second cutout 43. The second cutout 43 is formed in side end flap portion 62*b* in the manner to interrupt fold line 26 and is positioned between the fold line portions 42*a* and 42*b* to separate these portions 42*a* and 42*b*.

In the side end flap 64, fold line portion 40*c* extends from fold line 34 across side end flap portion 64*a* and terminates at a third cutout 45. Fold line portion 40*d* is formed in side end flap wall portion 64*b* and extends from the third cutout 45 to an end of fold line portion 36*d*. The third cutout 45 is formed in the side end flap portion 64*a* in the manner to interrupt fold line 28 and is positioned between fold line portions 40*c* and 40*d* to separate these portions 40*c* and 40*d*. Fold line portion 42*c* extends from fold line 34 across side end flap portion 66*a* and terminates at a fourth cutout 47. Fold line portion 42*d* is formed in side end flap portion 66*b* and extends from the fourth cutout 47 to an end of fold line portion 38*d*. The fourth cutout 47 is formed in side end flap portion 66*a* in the manner to interrupt fold line 28 and is positioned between fold line portions 42*c* and 42*d* to separate these portions 42*c* and 42*d*. Fold line portions 40*a*-40*d* do not connect with each other and fold line portions 42*a*-42*d* also do not connect with each other.

A first elongated web panel 72 extends between top end flap 56 and side end flap 60. A second elongated web panel 74 extends between top end flap 56 and side end flap 64. A third elongated web panel 76 extends between top end flap 58 and side end flap 62. A fourth elongated web panel 78 extends between top end flap 58 and side end flap 66.

Figure 3:
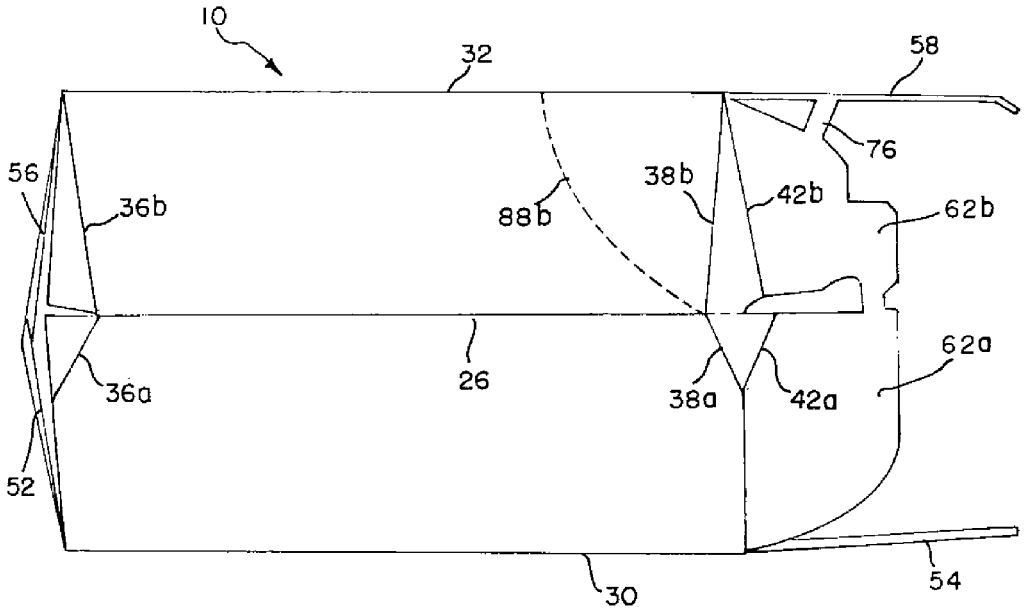
FIG. 3 illustrates a side view of a partially erected carton formed from the blank of FIG. 2.
Figure 4:
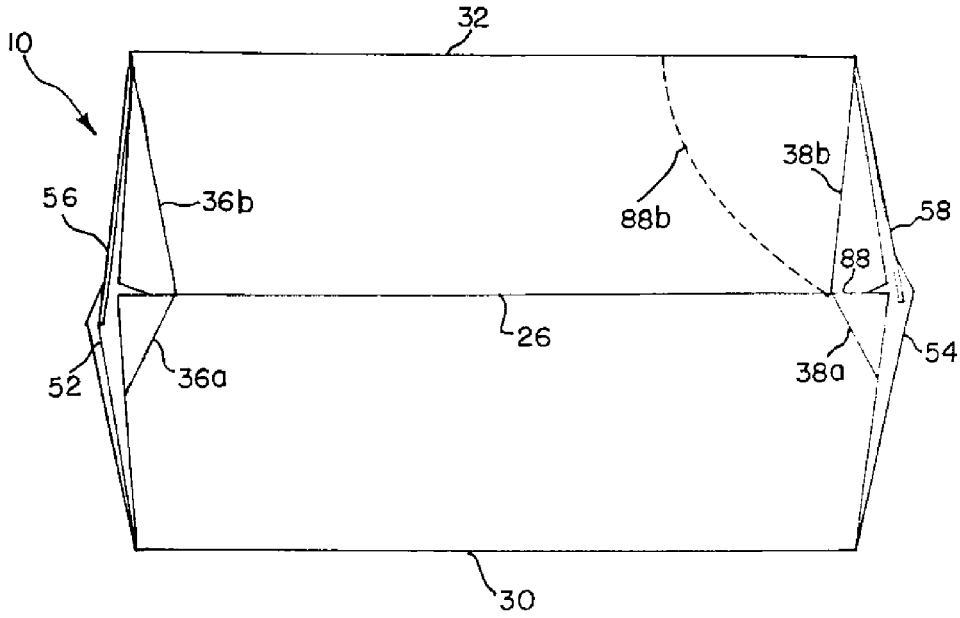
FIG. 4 illustrates a side view of the carton of FIG. 1.
Figure 5:
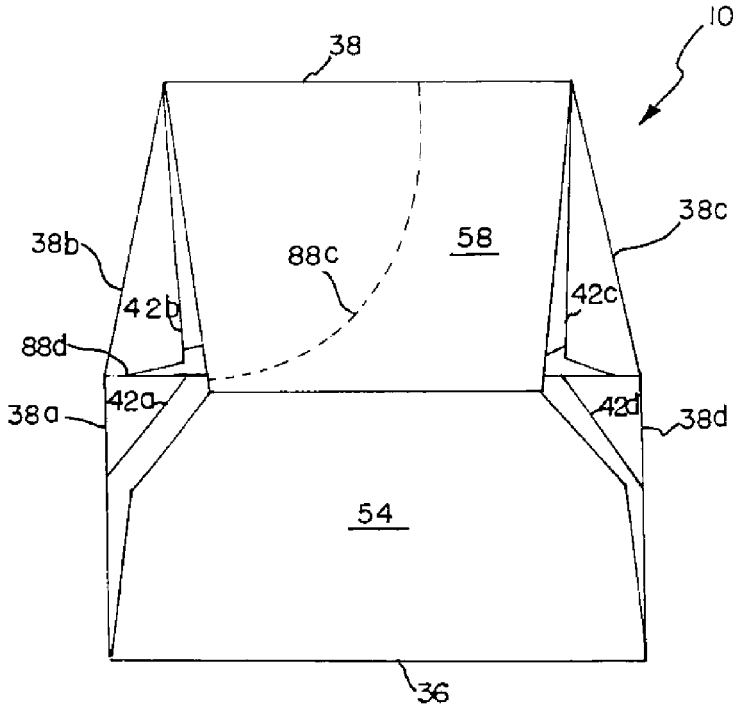
FIG. 5 illustrates an end view of the carton of FIG. 1.

In order to erect the carton 10, bottom wall 18 is glued or is otherwise secured to side wall 22 by edge flap 80, hingedly connected to second side wall 22 by fold line 82, to form the open ended tubular carton 10 as shown in FIG. 3. The fold lines 30, 32, 34 and 82 form the side edges of the carton 10. The transverse fold lines 36 and 38 form the end edges of the carton 10. After the articles are grouped and loaded through an open end of the carton 10, the end flaps are folded and secured together to form opposed end closure structures as shown in FIGS. 4 and 5. More specifically, side end flaps 60 and 64 are folded inwardly along the fold lines 36 and 40 so that side end flap 60 extends toward side end flap 64. Side end flaps 62 and 66 are folded inwardly along the fold lines 38 and 42 so that side end flap 62 extends toward side end flap 66. Top end flaps 56, 58 are folded downwardly along fold lines 36, 38 to be disposed over end flaps 60, 64; and 62, 66. Bottom end flaps 52, 54 are folded upwardly along fold lines 36, 38 and are secured to the outside surfaces of end flaps 56,58, respectively.

The cartons illustrated in the drawings are adapted to hold a group of similarly dimensioned cylindrical articles such as bottles. The articles in the carton 10 are preferably oriented in a side-by-side parallel fashion and in an upright manner, rather than disposed horizontally on their sides. The first and second side walls 20, 22 are disposed alongside the sides of the articles while the bottom of the articles rest on the bottom wall 18 of the carton 10.

As best shown in FIG. 1, the carton 10 of the present invention includes a removable portion 86 defined by endless tear line 88*a*-88*d*. The vertical size of the removable portion 86, preferably, is no less than half the size of the vertical size of the carton. Stated differently, the opening defined in the carton 10, once the removable portion 86 is removed, preferably has a vertical length that is at least a half of the height of the carton 10, but less than the height of the carton 10. The blank 16 in FIG. 2 best illustrates the endless tear line 88*a*-88*d*. The endless tear line 88*a*-88*d* is endless in that line portions 88*c*, 88*a*, 88*b* and 88*d* are connected one to the next to form a single continuous tear line in the blank 16 and that portion 88*c* extends and reaches the free/distal end of portion 88*d* when the carton 10 is erected. The endless tear line 88*a*-88*d* may be a line of severance or any other weakened line that facilitates separation along the length of the tear line 88. It is contemplated that the tear line includes, but is not limited to, a perforation, a line of short slits, a line of half cut, a combination of slits and score lines, or the equivalent.

A first portion 88*a* of the endless tear line 88*a*-88*d* is formed in the top wall 24 and extends between an end edge of the top wall 24 and a side edge of the top wall 24 corresponding with the fold lines 38 and 32, respectively. A second portion 88*b* is formed in side wall 20 to be continuous with the first portion 88*a*. As best shown in FIGS. 3 and 4, the portion 88*b* extends from the side edge (32) of the top wall 24 to an end edge (38) of the side wall 20. A third portion, which includes sub-portions 88*c* and 88*d*, is formed in one of the end closure structures of the carton 10 and extends between the end edge (38) of the top wall 24 and the end edge (38) of the side wall 20.

As best shown in FIG. 5, the sub-portion 88*c* extends between the end edge of the top wall 24, defined by transverse fold line 38, and the side edge of the top end flap 58. The sub-portion 88*d* extends from the distal end of end flap 62, merges with or interrupted by second cutout 43, emanates from cutout 43 and further extends to fold line 38. Sub-portions 88*c* and 88*d* combine with one another, or overlap somewhat, to form the third portion of the endless tear line 88*a*-88*d* in the one end closure structure of the carton 10. When the carton 10 is erected and end flaps 54 and 58 are folded and secured to one another, endless tear line portions 88*a*, 88*b*, 88*c* and 88*d* cooperate with one another to define the periphery of removable portion 86.

Figure 6:
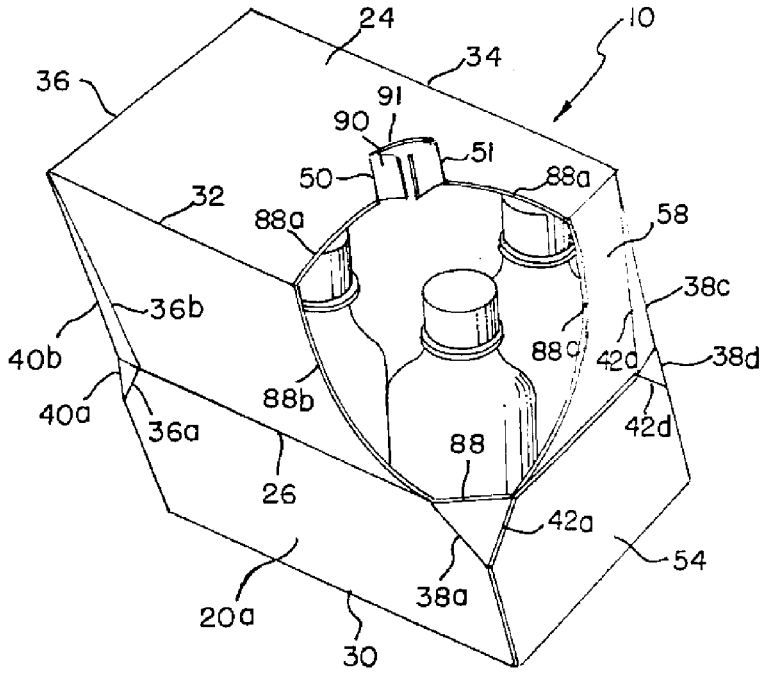
FIG. 6 is a perspective view of the carton of FIG. 1 having a portion removed for dispensing articles.

The top wall 24 of the carton 10 may also include a tear initiation tab 90 for facilitating tearing along the endless tear line 88*a*-88*d* and detachment of the removable portion 86 from the carton 10 as shown in FIG. 6. A distal end of the tear initiation tab 90 corresponds with a portion of the endless tear line portion 88*a* and the opposed proximal end 49 of the tear initiation tab 90 is detachably connected to the top wall 24. The tab 90 is foldably connected to the top wall 24 along its opposed side edges 50, 51. The tab 90 is formed with a center split line 91, such as a perforation, extending across the tab 90 between the distal and proximal ends. The tear initiation tab 90 may be pushed in to break the center split line 91 and to separate the tab 90 from the top wall 24 along the distal and proximal ends. The broken tab 90 creates an opening in the top wall 24 into which user's finger(s) may be inserted to initiate detachment of the removable portion 86 from the carton 10.

Figure 7:
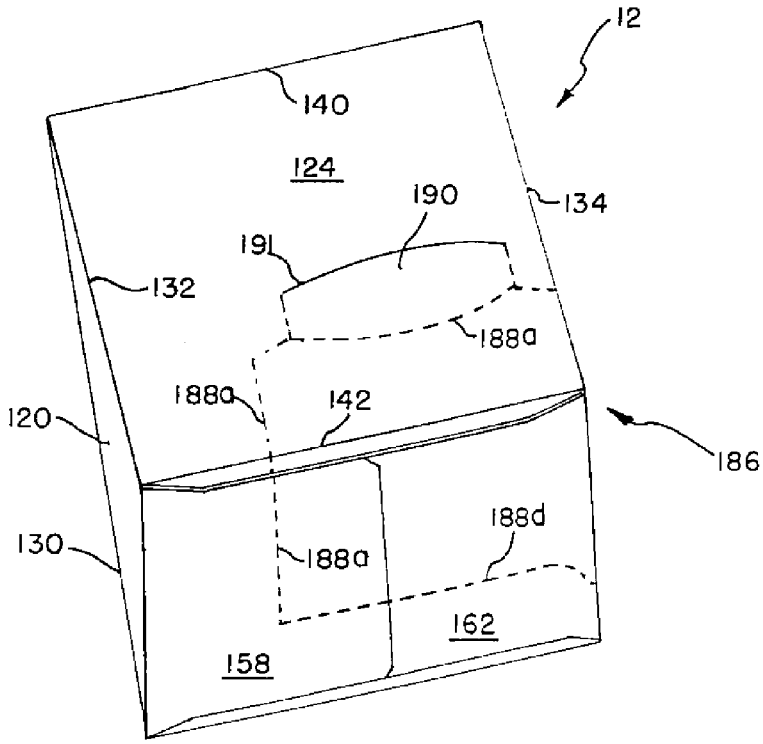
FIG. 7 is a perspective view of a carton of a second embodiment according to the present invention.
Figure 8:
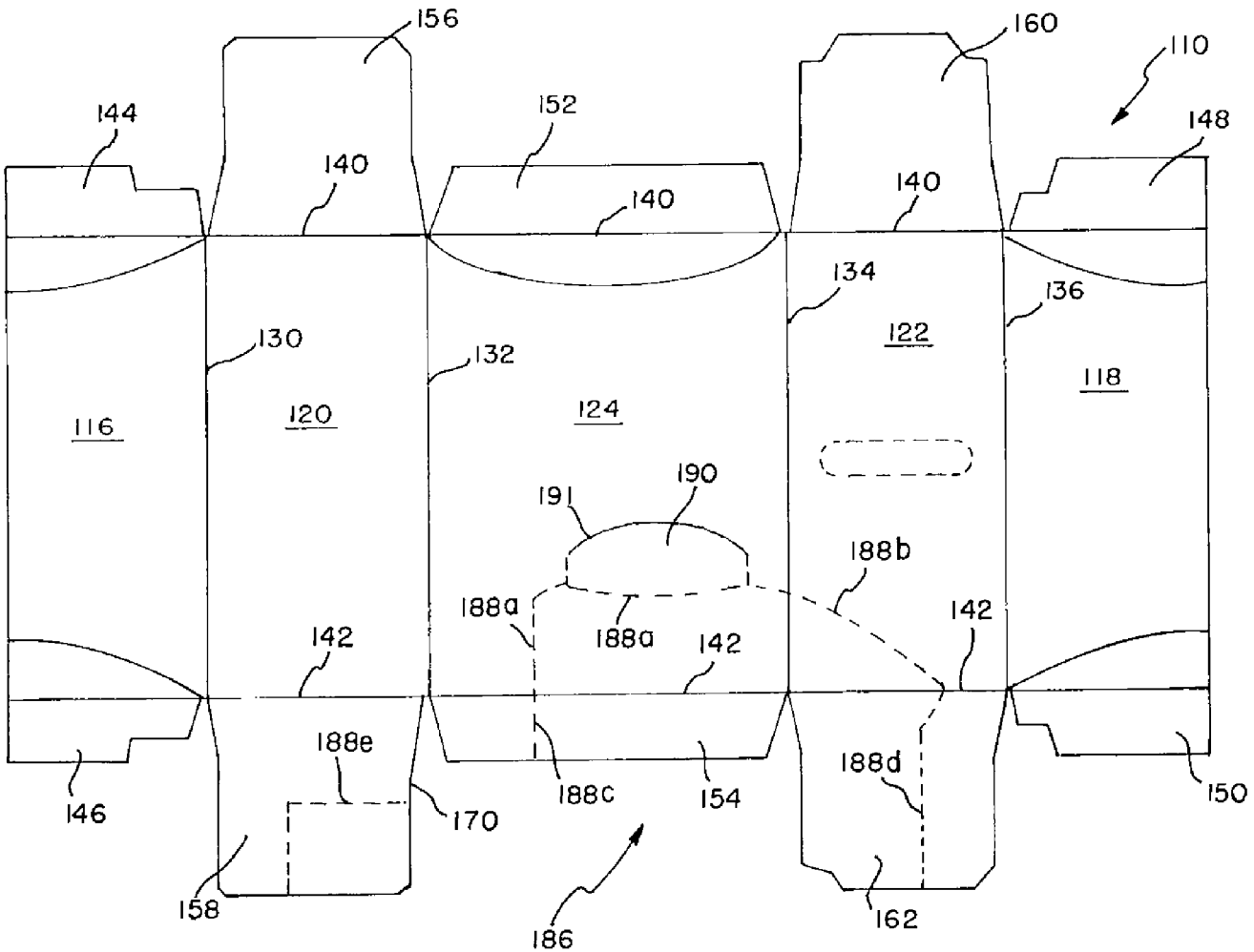
FIG. 8 illustrates a plan view of a blank for forming the carton of FIG. 7.

FIGS. 7-11 illustrate a carton 12 of an alternative embodiment formed from a blank 110. The blank 110 is configured as shown in FIG. 8 and includes five primary panels for forming the carton 12. The panels of the blank 110 are a first bottom wall panel 116, a second bottom wall panel 118, a first side wall 120, a second side wall 122, and a top wall 124.

As shown in FIG. 8, the panels of the blank 110 are hingedly connected in series to one another along fold lines 130, 132, 134 and 136. The first bottom wall panel 116 is hingedly connected to the first side wall 120 by fold line 130. The first side wall 120 is then hingedly connected to the top wall 124 by fold line 132. The second side wall 122 is then hingedly connected to the top wall 124 by fold line 134. The second bottom wall panel 118 is hingedly connected to the second side wall 122 by fold line 136. Each of the panels 116, 118, 120, 122 and 124 is provided with opposing end flaps hingedly connected thereto along transverse fold lines 140 and 142. Fold lines 140 and 142 each extend the full length of the blank 110. The first bottom wall panel 116 has opposing bottom end flap portions 144 and 146. The second bottom wall panel 118 has opposing bottom end flap portions 148 and 150. The top wall 124 has opposing top end flaps 152 and 154. First side wall 120 has opposing side end flaps 156 and 158. Second side wall 122 has opposing side end flaps 160 and 162.

In order to erect the carton 12, first bottom wall panel 116 and the second bottom wall panel 118 are glued or are otherwise secured together to form a tubular structure. In this structure, first and second bottom wall panels 116 and 118 provide a bottom wall 116/118 of the carton 12, the bottom end flap portions 144 and 148 provide a bottom end flap 144/148, and the bottom end flap portions 146 and 150 provide the other bottom end flap 146/150. The fold lines 130, 132, 134 and 136 form the side edges of the carton 12. The transverse fold lines 140 and 142 form the end edges of the carton 12. After the articles are grouped and loaded through an open end of the carton 12, the end flaps are folded and secured together to form opposed end closure structures to close the carton 12. More specifically, top end flaps 152 and 154 and bottom end flaps 144/148 and 146/150 are folded inwardly along fold lines 140, 142 so that the top end flaps 152 and 154 extend downwardly toward bottom end flaps 144/148 and 146/150, respectively. Side end flaps 160 and 162 are folded inwardly along fold lines 140, 142 to be disposed over top and bottom flaps 152, 144/148; and 154, 146/150, respectively. Side end flaps 156 and 158 are folded inwardly along fold lines 140, 142 and are secured to the outside surfaces of side end flaps 160, 162, respectively.

Figure 9:
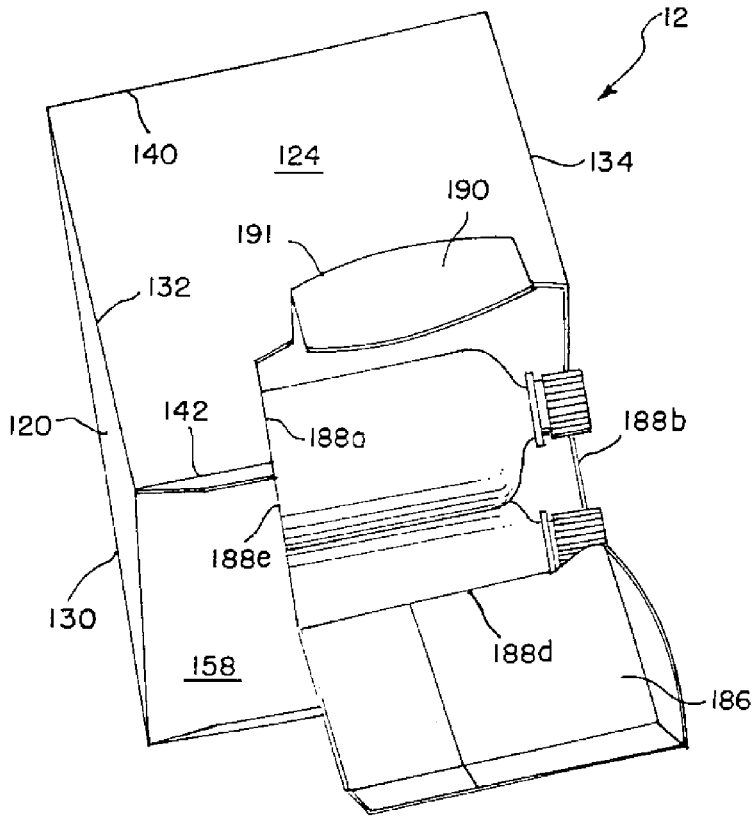
FIG. 9 is a perspective view of the carton of FIG. 7 formed from the blank of FIG. 8 with a portion of the carton partially detached for dispensing articles from the carton.
Figure 10:
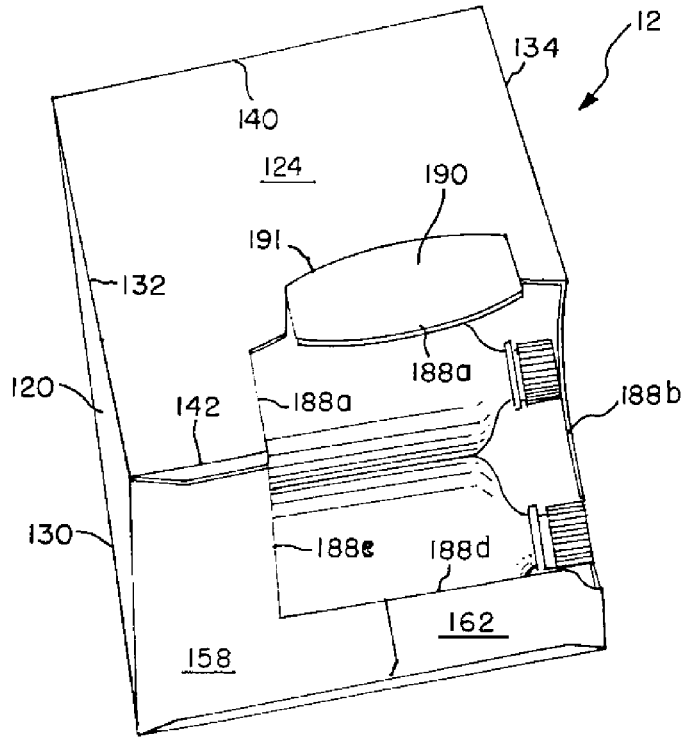
FIG. 10 is a perspective view of the carton of FIG. 7 formed from the blank of FIG. 8 with a portion of the carton completely detached for dispensing articles.
Figure 11:
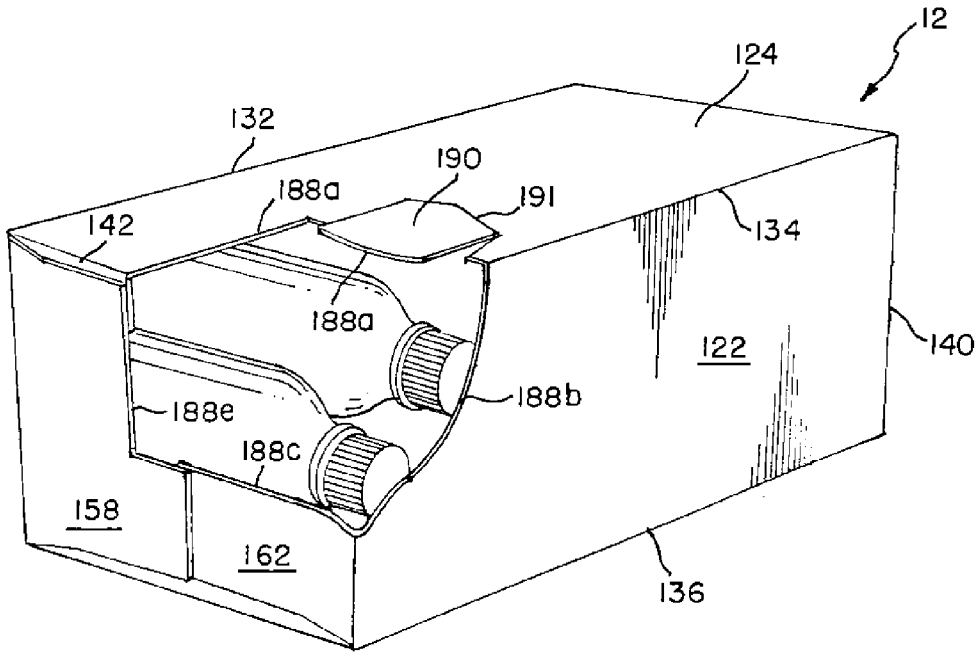
FIG. 11 is another perspective view of the carton of FIG. 7 formed from the blank of FIG. 8 with a portion of the carton completely detached for dispensing articles.

The carton 12 is configured to hold a group of similarly dimensioned, cylindrical articles, such as PET bottles, in a plurality of vertically arranged rows (two rows in FIGS. 9-11). The articles in each row are disposed on their sides in a side-by-side parallel fashion. The side walls 120 and 122 are disposed alongside the ends of the articles of the group while each end closure structure of the carton is disposed adjacent to the side walls of the respective endmost articles.

As shown in FIG. 7, the carton 12 of the present invention includes a removable portion 186 defined by endless tear line 188*a*- 188*d*. The blank 110 in FIG. 8 best illustrates the endless tear line 188*a*- 188*d*. The endless tear line 188*a*-188*d* is endless in that tear line portions 188*c*, 188*a*, 188*b* and 188*d* are connected one to the next to form a single continuous tear line in blank 110 and portion 188*e* in side end flap 158 interconnects the free end of portion 188*c* with the free end of portion 188*d* when the carton 12 is erected. The endless tear line 188*a*- 188*d* may be a line of severance or any other weakened line that facilitates separation along the length of the tear line 188*a*- 188*d*. It is contemplated that the tear line includes, but is not limited to, a perforation, a line of short slits, a combination of slits and score lines, or the equivalent.

A first portion 188*a* of the endless tear line 188*a*-188*d* is formed in the top wall 124 and extends between an end edge of the top wall 124, defined by fold line 142, and a side edge of the top wall 124, defined by fold line 134. A second portion 188*b* is formed in one 122 of the side walls. As best shown in FIG. 8, the portion 188*b* extends from the side edge of the top wall 124, defined by fold line 134, to the end edge of the side wall 122, defined by the fold line 142. A third portion, which includes three sub-portions 188*c*, 188*d*, and 188*e*, is formed in one of the end closure structures adjacent to portions 188*a*, 188*b*.

As best shown in FIG. 8, the sub-portion 188*c* is formed in the end flap 154 of the top wall 124. The sub-portion 188*c* extends from transverse fold line 142 to the distal end of the top end flap 154. Sub-portion 188*d* is formed in the end flap 162 of the side wall 122. The sub-portion 188*d* extends from transverse fold line 142 to the distal end of the side end flap 162. Sub-portion 188*e* is formed in the end flap 158 of the side wall 120. The sub-portion 188*e* is L-shaped and extends from a side/upper edge 170 of the side end flap 158 to the distal end of the side end flap 158.

When the carton 12 is erected and end flaps 154, 158 and 162 are secured to one another, the sub-portion 188*c* is oriented substantially vertically and the sub-portion 188*d* is oriented substantially horizontally. The L-shaped sub-portion 188*e* interconnects the sub-portions 188*c* and 188*d* such that the upper vertical arm section of the sub-portion 188*e* is aligned with the sub-portion 188*c* and the lower horizontal section of the sub-portion 188*e* is aligned with the sub-portion 188*d*. Endless tear line portions 188*a*, 188*b*, 188*c*, 188*d*, and 188*e* cooperate with one another to define the periphery of removable portion 186 in the erected carton 12. FIG. 9 illustrates the removable portion 186 partially removed from the carton 12 to dispense articles. The removable portion 186 may be completely removed from the carton 12 as shown in FIGS. 10 and 11.

The top wall 124 of the carton 12 may also include a tear initiation tab 190 for facilitating tearing along the endless tear line 188*a*-188*e* and detachment of the removable portion 186 from the carton 12. A distal end of the tear initiation tab 190 corresponds with a portion of the endless tear line portion 188*a* and the proximal end of the tear initiation 190 is foldably connected to the top wall 124 along arched fold line 191. The tear initiation tab 190 may be pushed in or pulled out to initiate detachment of the removable portion 186 from the carton 12.

Figure 12:
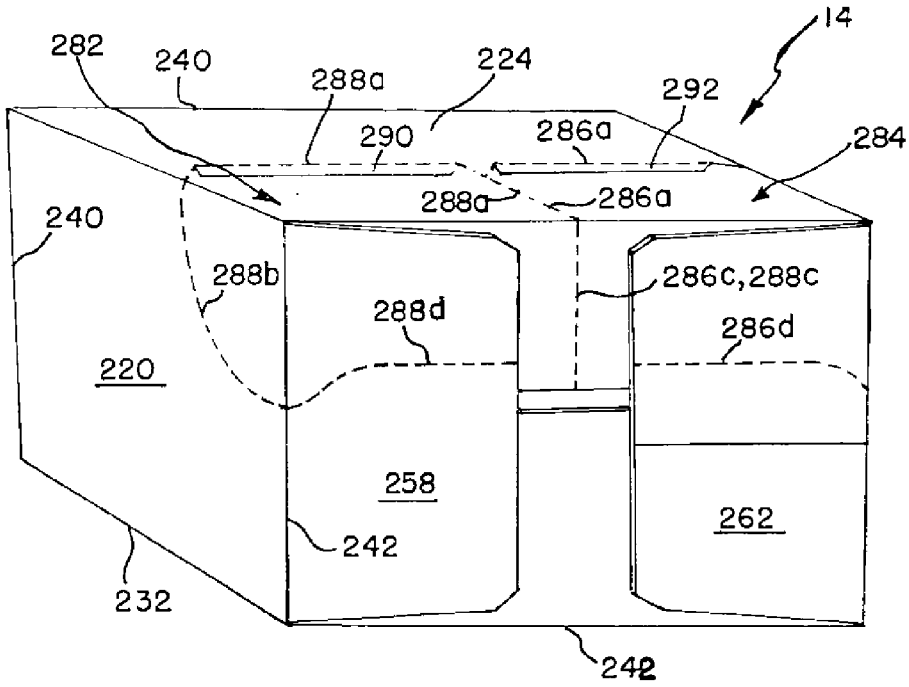
FIG. 12 is a perspective view of a carton of a third embodiment according to the present invention.
Figure 13:
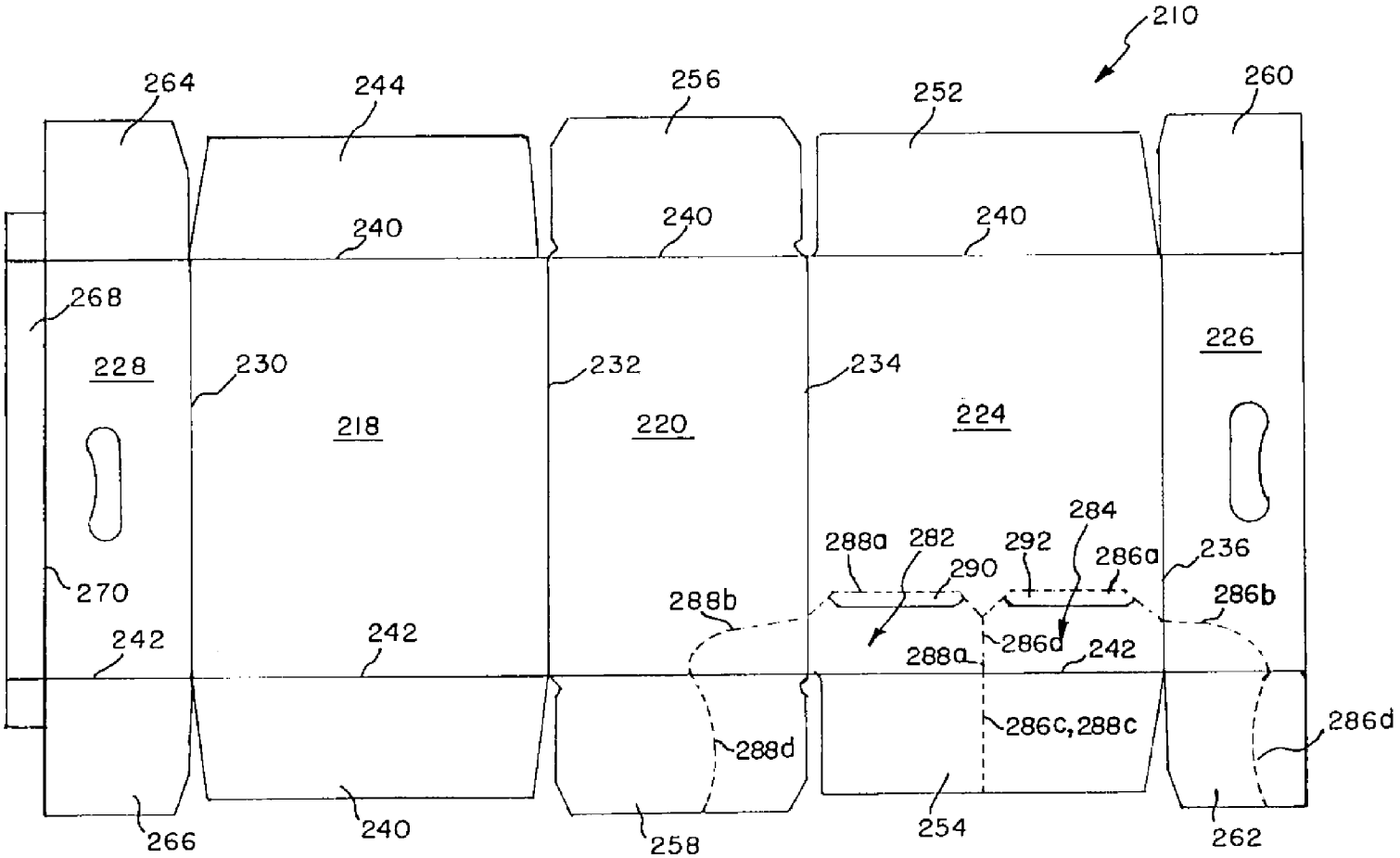
FIG. 13 illustrates a plan view of a blank for forming the carton of FIG. 12.

FIGS. 12-16 illustrate a carton 14 of another alternative embodiment of the present invention. The carton 14, as shown in FIG. 12, is formed from a blank 210 configured as shown in FIG. 13. The five primary panels of the blank 210 are a bottom wall 218, a left side wall 220, a top wall 224, a first right side wall panel 226, and a second right side wall 228.

As shown in FIG. 13, the panels of the blank 210 are hingedly connected in series to one another along fold lines 230, 232, 234 and 236. The bottom wall 218 is hingedly connected to the left side wall 220 by fold line 232. The left side wall 220 is then hingedly connected to the top wall 224 by fold line 234. The first right side wall panel 226 is then hingedly connected to the top wall 224 by fold line 236. The second right side wall panel 228 is hingedly connected to the bottom wall 218 by fold line 230.

Each of the panels 218, 220, 224, 226 and 228 is provided with opposing end flaps hingedly connected thereto by transverse fold lines 240 and 242. Fold lines 240 and 242 each extend the full length of the blank 210. The bottom wall 218 has opposing bottom end flaps 244 and 246. The top wall 224 has opposing top end flaps 252 and 254. Left side wall 220 has opposing side end flaps 256 and 258. First right side wall panel 226 has opposing side end flap portions 260 and 262. Second right side wall panel 228 has opposing side end flap portions 264 and 266.

In order to erect the carton 14, first right side wall panel 226 and second right side wall panel 228 are glued or are otherwise secured together along their outer side edges to form a tubular structure. In the tubular structure, the first and second right side panels 226 and 228 provide a vertical right side wall 226/228, the side end flap portions 260 and 264 provide a side end flap 260/264 and the side end flap portions 262 and 266 provide the other side end flap 262/266. A handle-reinforcing panel 268 that is hingedly connected to second right side wall panel 228 is folded downwardly along fold line 270 to be in face-contacting relationship with the inside surface of the second right side wall panel 228. The fold lines 230, 232, 234 and 236 form the side edges of the carton 14. The transverse fold lines 240 and 242 form the end edges of the carton 14. After the articles are grouped and loaded through one or both the open ends of the tubular structure, the end flaps are folded inwardly and secured together to form opposed end closure structures to close the carton 14. More specifically, top end flaps 252, 254 and bottom end flaps 244, 246 are folded inwardly along fold line 240, 242 so that the top end flap 252 and 254 extend downwardly toward bottom end flaps 244 and 246, respectively. Side end flaps 256, 258 are folded inwardly along fold lines 240, 242 and are secured to the outside surfaces of top and bottom flaps 252, 244; and 254, 246, respectively. Side end flaps 260/264 and 262/266 are folded inwardly along fold lines 240, 242 and are secured to the outside surfaces of top and bottom flaps 252, 244; and 254, 246 respectively.

In one embodiment, the carton 14 is a double stack carton as shown in FIG. 12. The carton contains two tiers of similarly dimensioned cylindrical articles such as cans. The two tiers are arranged side by side with a partition panel 272 (FIG. 16) placed in-between. Each tier includes three rows four articles each. The three rows in each tier are arranged vertically, one row above the other, to define the respective tier. The four articles in each row are disposed on their sides in a side-by-side parallel fashion. The partition panel 272 extends between the top wall 224 and the bottom wall 218 within the interior of the carton 14 and is placed between the two side-by-side tiers of articles. The articles in one tier on one side of the partition panel 272 are in an end-to-end relationship with the articles in the other tier on the opposite side of the partition panel 272. The left side wall 220 is disposed alongside the ends of the articles of one tier and the right side wall 226/228 are disposed alongside the ends of the articles of the other tier. Each end closure structure of the carton 14 is disposed adjacent to the side walls of the respective endmost articles.

As shown in FIG. 12, the carton 14 of the present invention includes a first removable portion 282 and a second removable portion 284. Two dispensing openings are defined by detaching the first and second removable portions 282 and 284 respectively to permit the articles of both tiers to be removed from the end of the carton 14. The first removable portion 282 provides the dispensing opening for the articles of one tier on one side of the partition panel 272 while the second removable portion 284 provides the dispensing opening for the articles of the other tier on the other side of the partition panel 272.

Each of the removable portions 282 and 284 are defined by a tear line. The blank 210 in FIG. 13 best illustrates two tear lines, i.e., a tear line 286*a*-286*d* and a tear line 288*a*-288*d*, which correspond with removable portion 282 and removable portion 284, respectively. When the carton 14 is erected, the removable portion 282 and the removable portion 284 are interconnected, or bounded on one another, along a common portion of the tear lines 286*a*-286*d* and 288*a*-288*d*. Each of the tear lines 286*a*-286*d* and 288*a*-288*d* may be a perforation, a line of short slits, a line of half cut, a combination of slits and score lines, or the equivalent that facilitates separation along their length.

A first portion 286*a* of the tear line 286*a*-286*d* is formed in the top wall 224 and extends between the end edge of the top wall 224, defined by fold line 242, and the side edge of the top wall 224, defined by fold line 236. A second portion 286*b* is formed in the right side wall 226. The portion 286*b* extends from the side edge of the top wall 224, defined by fold line 236, to the end edge of the side wall 226, defined by the fold line 242. A third portion of the tear line 286*a*-286*d* includes sub-portions 286*c* and 286*d* formed in one of the end closure structures of the carton 14.

As best shown in FIG. 13, the sub-portion 286*c* is formed in the top end flap 254 of the top wall 224. The sub-portion 286*c* extends from fold line 242 to the distal or lower end of the top end flap 254. Sub-portion 286*d* is formed in the side end flap portion 262 of the first right side wall panel 226. The sub-portion 286*d* extends from fold line 242 to the distal end of the side end flap portion 262. When the carton is erected, the lower end of the sub-portion 286*c* is located adjacent to, but spaced from, the distal end of the sub-portion 286*d* that is offset from the lower edge of the top end flap 254 when viewed from the respective end of the carton (see FIG. 12). However, a gap between the distal ends of the top and bottom end flaps 246, 254 substantially interconnects the sub-portions 286*c* and 286*d* as best shown in FIG. 12.

Referring further to FIG. 13, a first portion 288*a* of the tear line 288*a*-288*d* is formed in the top wall 224 and extends between the end edge of the top wall 224, defined by fold line 242, and the side edge of the top wall 224, defined by fold line 234. A second portion 288*b* is formed in the left side wall 220. The portion 288*b* extends from the side edge of the top wall 224, defined by fold line 234, to the end edge of the side wall 220, defined by the fold line 242. A third portion of the tear line 288*a*-288*d* includes sub-portions 288*c* and 288*d* formed in the other end closure structure of the carton 14. The sub-portion 288*c* is formed in the top end flap 254 while the sub-portion 288*d* is formed in the side end flap 258. The portion 288*c* extends from fold line 242 to the distal or lower end of the end flap 254. Because the removable portions 282 and 284 border one another, the tear line portion 288*c* and a part of the tear line portion 288*a* are coincidental, or in registry, with the tear line portion 286*c* and a part of the tear line portion 286*a*. These registered parts of the two tear lines extend perpendicular from the transverse fold line 242 and define the common tear line portion.

The sub-portion 288*d* extends from fold line 242 to the distal end of the side end flap 258. When the carton is erected, the lower end of the sub-portion 288*c* is located adjacent to, but spaced from, the distal end of the sub-portion 288*d* that is offset from the lower edge of the top end flap 254 when viewed from the respective end of the carton (see FIG. 12). However, a gap between the distal ends of the top and bottom end flaps 246, 254 substantially interconnects the sub-portions 288*c* and 288*d* as best shown in FIG. 12.

Figure 14:
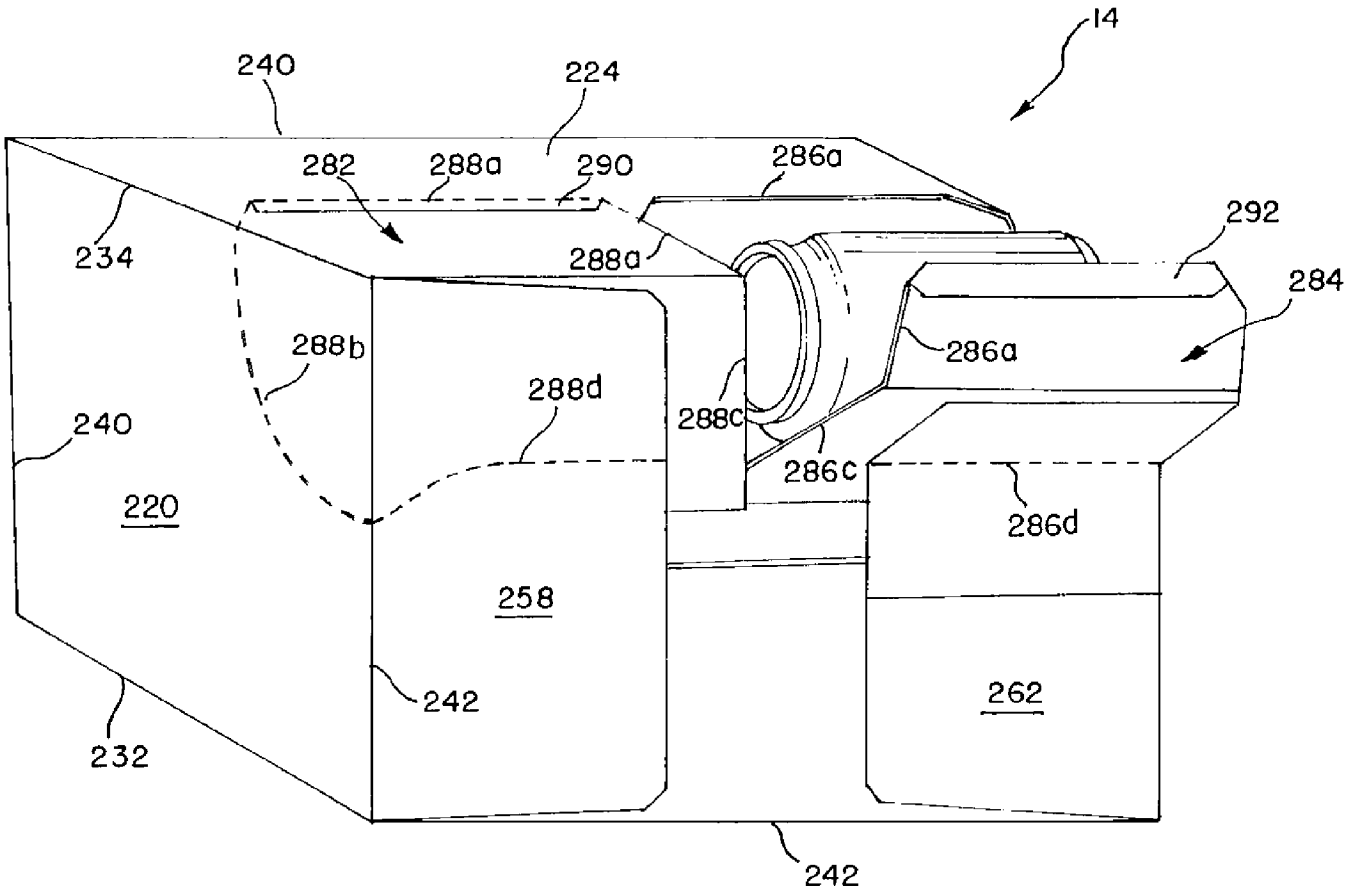
FIG. 14 is a perspective view of the carton of FIG. 12 formed from the blank of FIG. 13 with a portion of the carton partially detached for dispensing articles from the carton.
Figure 15:
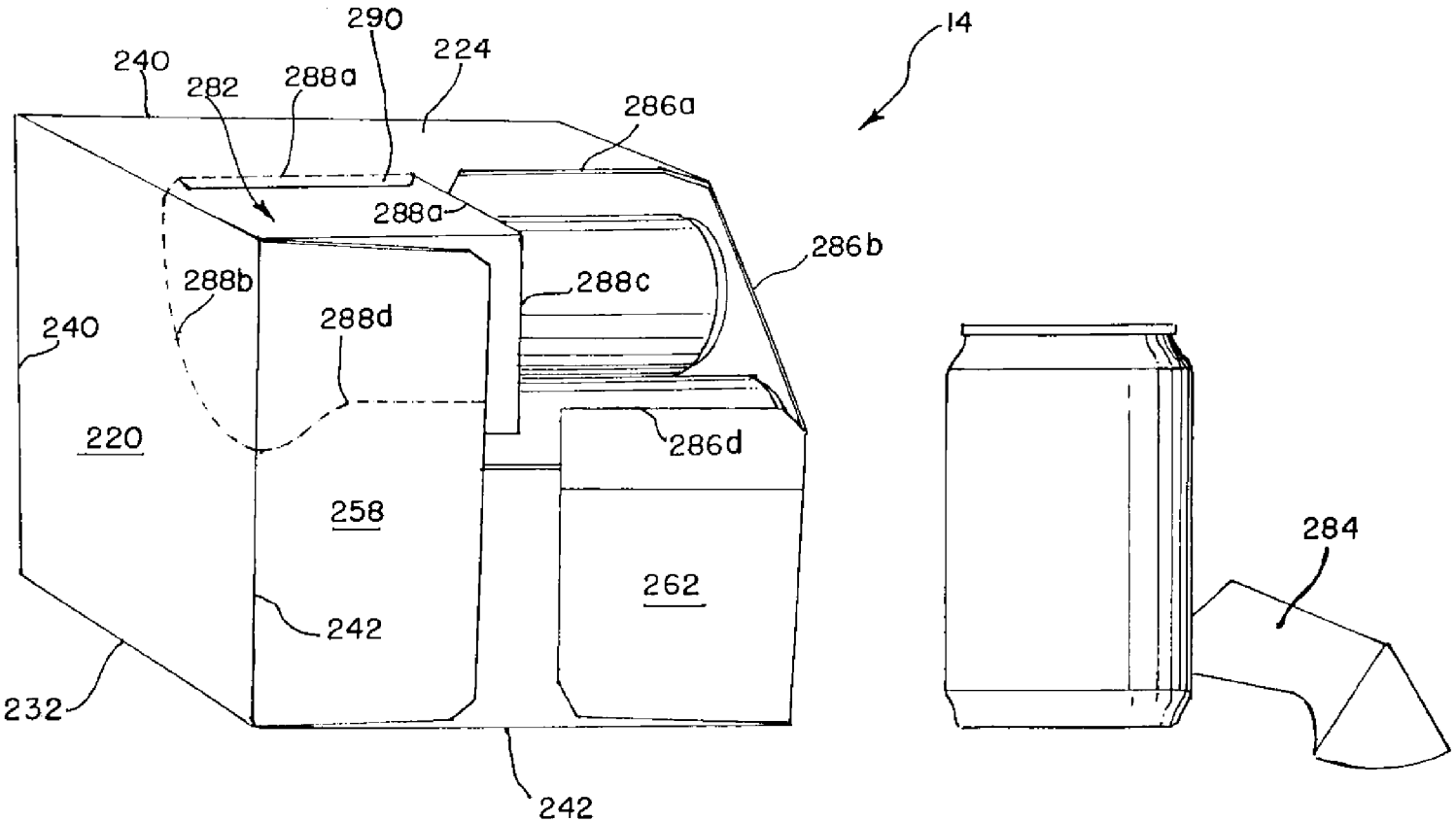
FIG. 15 is a perspective view of the carton of FIG. 12 formed from the blank of FIG. 13 with a portion of the carton completely detached for dispensing articles.
Figure 16:
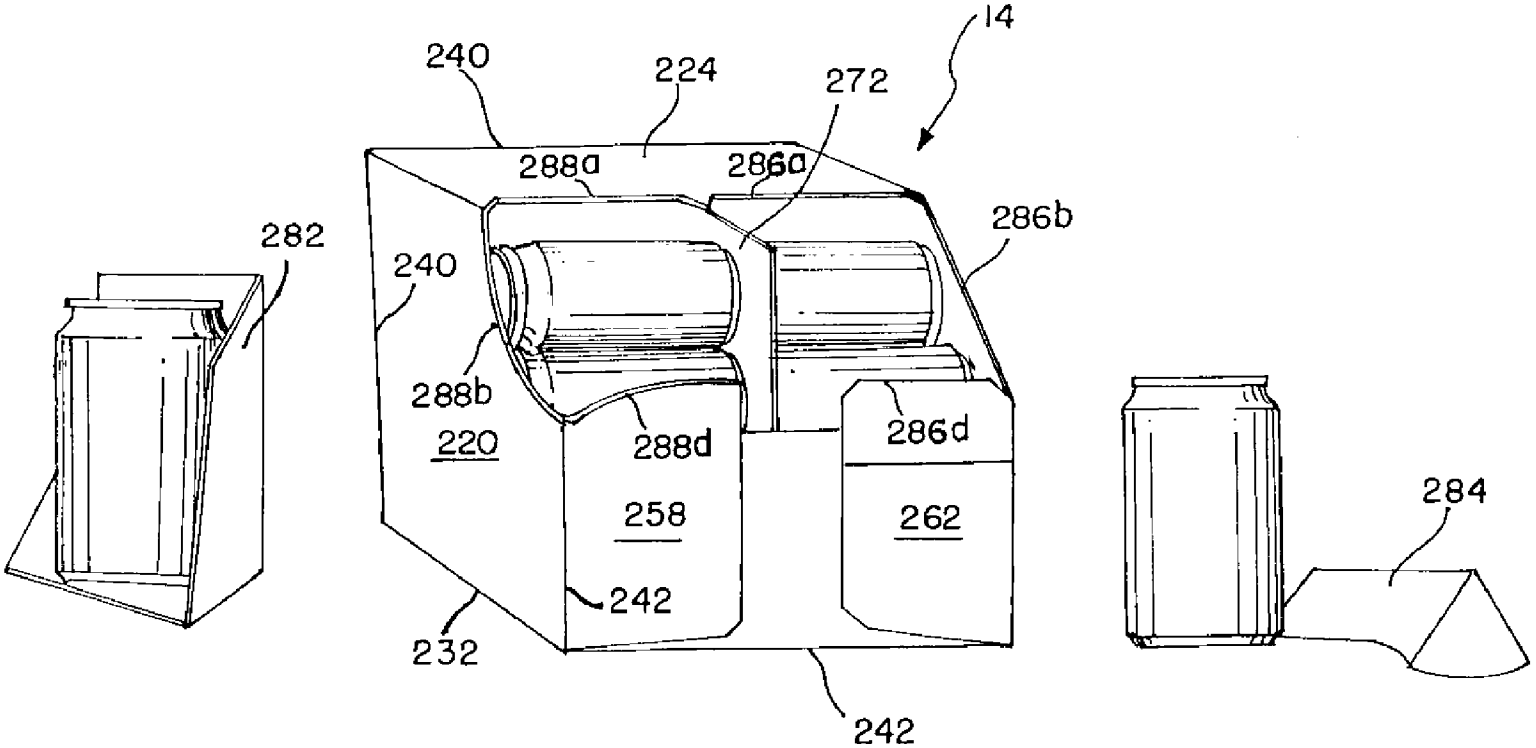
FIG. 16 is a perspective view of the carton of FIG. 12 formed from the blank of FIG. 13 with a second portion completely detached from the carton for dispensing articles.

Tear line portions 286*a*, 286*b*, 286*c*, and 286*d* cooperate with one another to define the periphery of removable portion 284 in the erected carton 14. Tear line portions 288*a*, 288*b*, 288*c*, and 288*d* cooperate with one another to define the periphery of removable portion 282 in the erected carton 14. FIG. 14 illustrates the removable portion 284 partially removed from the carton 14 to dispense articles. The removable portion 284 may be completely removed from the carton 14 as shown in FIGS. 15 and 16. FIG. 16 also illustrates the removable portion 282 completely removed from the carton 14.

The top wall 224 of the carton 14 may also include a pair of tear initiation tabs 290 and 292 for facilitating tearing along portions of the tear lines 288*a*-288*d* and 286*a*-286*d*, respectively. A distal end of the tear initiation tab 290 corresponds with a portion of the tear line portion 288*a* and the proximal end of the tear initiation 290 is foldably connected to the removable portion 282. A distal end of the tear initiation tab 292 corresponds with a portion of the tear line portion 286*a* and the proximal end of the tear initiation 292 is foldably connected to the removable portion 284. The tear initiation tabs 290, 292 may be pushed in or pulled out to initiate detachment of the removable portions 282, 284 from the carton 14.

Figure 17:
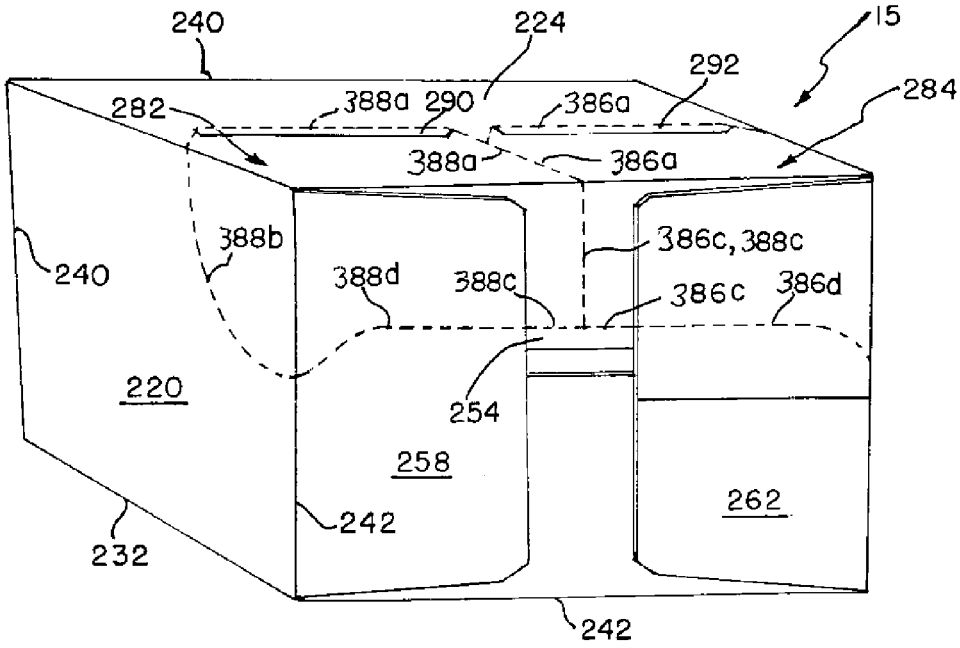
FIG. 17 is a perspective view of a carton of a fourth embodiment according to the present invention.
Figure 18:
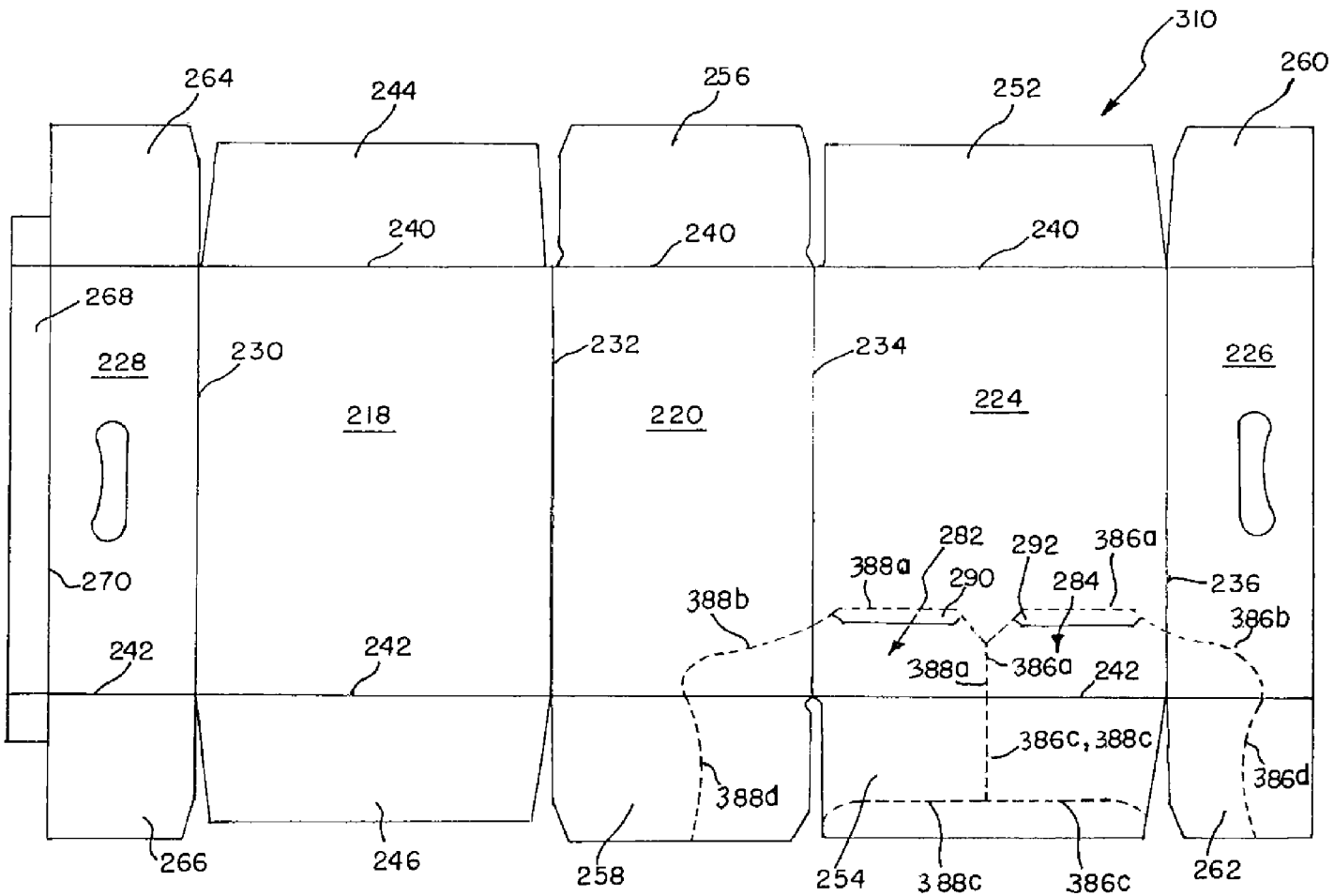
FIG. 18 illustrates a plan view of a blank for forming the carton of FIG. 17.
Figure 19:
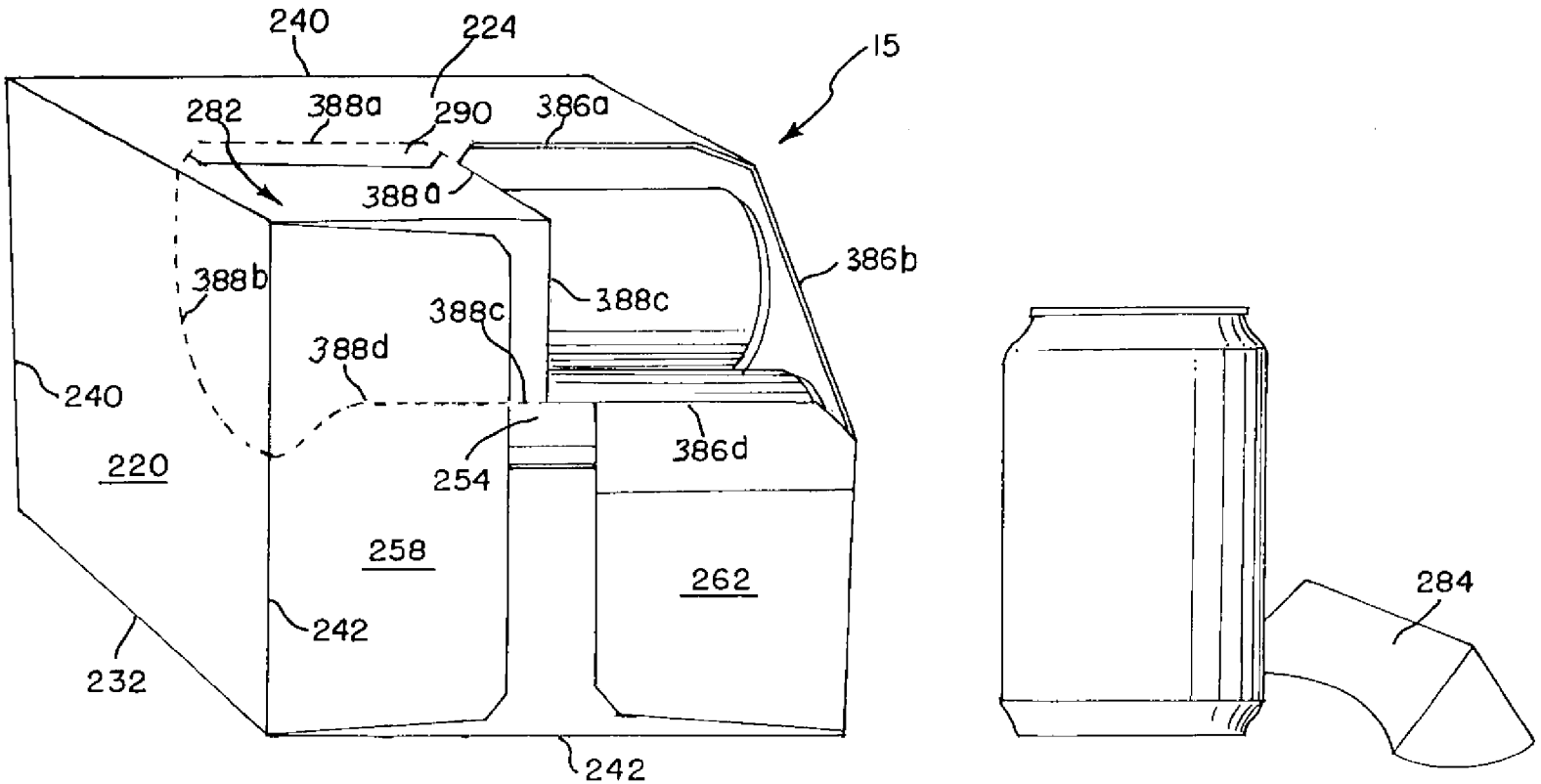
FIG. 19 is a perspective view of the carton of FIG. 17 formed from the blank of FIG. 18 with a portion of the carton completely detached for dispensing articles.

"FIGS. 17-19 illustrate another alternative embodiment (the fourth embodiment) of a carton 15 of the present invention. In this embodiment, the carton 15 is a double stack carton formed from a blank 310 shown in FIG. 18. The five primarypanels of the blank 310 are similar to the" blank 210 for forming carton 14, described above. Therefore, like portions are designated by like reference numerals. The carton 15 differs from the carton 14 because of a modification to the end flap 254, as described below.

"As shown in FIG. 17, the carton 15 of the present invention also includes the first removable portion 282 and the second removable portion 284. However, these removable portions 282 and 284 each is defined by an endless tear line. This is because the third portion of each of the tear lines have been modified to permit each of the tear lines 386*a*-*d* and 388*a*-*d* to be endless. The sub-portions 386*c*, 388*c* of the blank 310 are distinguishable from the sub-portions 286*c*, 288*c* of the blank 210. In particular, each of the sub-portions 386*c*, 388*c* of blank 310 is substantially L-shaped as shown in FIG. 1.8. The sub-portion 388*c* may be referred to as being flipped horizontally relative the sub-portion 386*c*."

"Referring further to FIG. 17, the parts of tear line portions 386*a* and 388*a* which extend perpendicular to the transverse fold line 242 define a part of the common tear line portion. The parts of the tear line sub-portions 386*c* and 388*c* of blank 310 which extend perpendicular to the transverse fold line 242 define the other part of the common tear line portion. Staled differently, only the upper vertical arm portion of each of the L-shaped tear line sub-portions 386*c* and 388*c* define the other part of the common tear line portion because the sub-portions 386*c*, 388*c* do not extend entirely across the top end flap 254. The lower distal end of the top end flap 254 is offset from the sub-portions 386*d*, 388*d* when viewed from the end of the carton 15."

"Also, as best shown in FIG. 18, the lower horizontal arm portions of the sub-portions 386*c* and 388*c* together define a single horizontal tear line that is displaced from the distal or lower end of end flap 254. The horizontal tear line terminates at opposite side edges of the top end flap 254. As best shown in FIG. 19, a distal portion of the end flap 254 below"the horizontal tear line remains attached to the carton 15 after the removable portion 284 is completely removed from the carton 15. This distal portion of the end flap 254 is partially obscured from view in FIG. 19 behind the folded end flaps 258, 262, and remains attached to the carton 15 even after removal of removable portion 282.

"As best shown in FIG. 17, the lower horizontal arm portions of the sub-portions 386*c* and 388*c* are aligned and continuous with the sub-portions 386*d*, 388*d* respectively when the carton is erected. Further, the lower horizontal arm portions of sub-portions 386*c* and 388*c* that defines the single horizontal tear line interconnect the sub-portions 386*d* and 388*d* when the carton 15 is erected."

Figure 20:
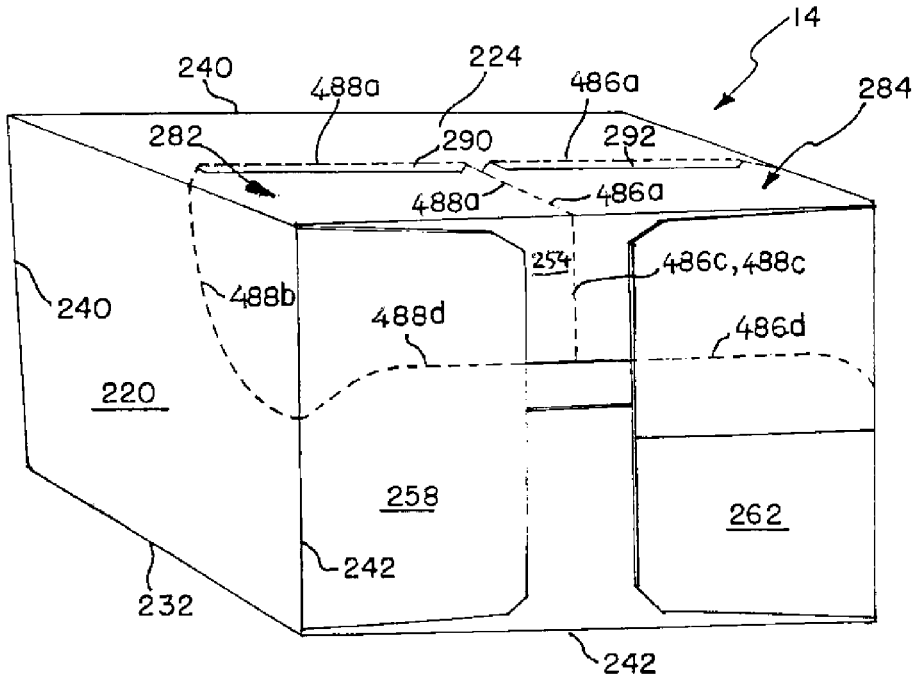
FIG. 20 is a perspective view showing a modified form of the carton of FIG. 12.

"In the third embodiment described above, the distal ends of the sub-portions 286*d* and 288*d* are offset from the lower edge of the top end flap 254 when viewed from the respective end of the carton (see FIG. 12). However, the elevation of either the sub-portions 286*d* and 288*d* or the lower edge of the top end panel 254 may be adjusted such that the sub-portions 286*d* and 288*d* are aligned with the lower edge of the top end flap 254. FIG. 20 illustrates such a modified form wherein the sub-portions 486*d* and 488*d* are aliszned with the lower edge of the top end flap 254."

It will be recognised that as used herein, directional references such as "top", "bottom", "upper", "lower", "right", "left", "end", and "side" do not limit the respective walls or panels to such orientation, but merely serve to distinguish these panels from one another. Any reference to hinged connection should not be construed as necessarily referring to a single fold line only: indeed it is envisaged that hinged connection can be formed from one or more of one of the following, a perforation, a score line, a frangible line or a fold line, without departing from the scope of invention.

The present invention has been illustrated in relation to a particular embodiment which is intended in all respects to be illustrative rather than restrictive. Those skilled in the art will recognize that the present invention is capable of many modifications and variations without departing from the scope of the invention. Accordingly, the scope of the present invention is described by the claims appended hereto and supported by the foregoing.

What is claimed is:

1. A carton comprising top and bottom opposed walls interconnected by a pair of side walls to form a tubular body for accommodating a plurality of articles; a pair of end closure structures for at least partially closing opposite ends of the tubular body; and an article dispenser provided by a first removable portion of the carton defined by an endless tear line, the endless tear line comprising:

a first portion formed in the top wall and extending between an end edge of the top wall and a side edge of the top wall;

a second portion formed in one of the side walls and extending from the side edge of the top wall to an end edge of the side wall; and a third portion formed in one of the end closure structures and extending between the end edge of the top wall and the end edge of the side wall, wherein the one end closure structure comprises a top end flap hingedly connected to the end edge of the top wall and a side end flap hingedly connected to the end edge of the one side wall, the top end flap extending downwardly from the top wall, the side end flap extending from the one side wall toward the other side wall, and the third portion of the endless tear line comprises a first sub-portion and a second subportion, the first sub-portion being formed in the top end flap, the second sub-portion being formed in the side end flap, wherein the one end closure structure further comprises a bottom end flap hingedly connected to an end edge of the bottom wall, the bottom end flap extending upwardly from the bottom wall, the third portion of the endless tear line further comprises a third sub-portion formed in the bottom end flap, the third sub-portion interconnecting the first and second sub-portions.

2. The carton of claim 1 further comprising a tear initiation tab at least partially defined by a portion of the first portion of the endless tear line.

3. The carton of claim 1 wherein the first sub-portion extends downwardly from the end edge of the top wall to a lower edge of the top end flap, the second sub-portion extends from the end edge of the one side wall to a distal edge of the side end flap, and the third sub-portion extends from an upper edge of the bottom and flap to a side edge of the bottom end flap.

4. The carton of claim 1 wherein the size of the first removable portion along the end edge of one of the top wall and the one side wall is no less than half the size of the one of the top wall and the one side wall along the end edge thereof.

5. The carton of claim 1 wherein the carton is configured to accommodate a two-tier group of articles, the carton further comprising a divider panel adapted to be placed between the two-tiers of the group of articles.

6. The carton of claim 3 wherein the lower edge of the top end flap is offset from the second sub-portion of the tear line when viewed from an end of the carton.

7. The carton of claim 3 wherein the lower edge of the top end flap is aligned with the second sub-portion of the tear line when viewed from an end of the carton.

8. The carton of claim 3 wherein the third sub-portion is L-shaped, the third sub-portion comprising an upper ann section aligned with the first sub-portion and an lower arm section aligned with the second sub-portion.

9. A carton comprising top and bottom opposed walls interconnected by a pair of side walls to form a tubular body for accommodating a plurality of articles: a pair of end closure structures for at least partially closing opposite ends of the tubular body; and an article dispenser provided by a first removable portion of the carton defined by an endless tear line, the endless tear line comprising:

a first portion formed in the top wall and extending between an end edge of the top wall and a side edge of the top wall;

a second portion formed in one of the side walls and extending from the side edge of the top wall to an end edge of the side wall; and a third portion formed in one of the end closure structures and extending between the end edge of the top wall and the end edge of the side wall, wherein the one end closure structure comprises a top end flap hingedly connected to the end edge of the top wall and a side end flap hingedly connected to the end edge of the one side wall, the top end flap extending downwardly from the top wall, the side end flap extending from the one side wall toward the other side wall and the third portion of the endless tear line comprises a first sub-portion and a second sub-portion, the first sub-portion being formed in the top end flap, the second sub-portion being formed in the side end flap, wherein said article dispenser further provided by a second removable portion defined by an endless tear line formed at least in part in the one end closure structure.

10. The carton of claim 9 wherein the first and second removable portions bounds on each other along a common portion of the respective endless tear lines of the first and second removable portions.

11. The carton of claim 10 wherein the common portion of the endless tear lines is formed at least in part in the one end closure structure.

12. The carton of claim 11 wherein the common portion of the endless tear lines extends from the one end closure structure into the top wall.

13. The carton of claim 11 wherein the one end closure structure comprises a top end flap hingedly connected to the end edge of the top wall and a side end flap hingedly connected to the end edge of the one side wall, the top end flap extending downwardly from the top wail, and the common portion of the endless tear lines is formed at least in part in the top end flap.

14. The carton of claim 13 wherein the top end flap is formed further with a severance line intersecting with a lower end of the common portion, the severance line extending across the top end flap to provide respective portions of the endless tear lines.

15. The carton of claim 9 wherein the second removable portion is provided by a portion of the top wall, a portion of the other side wall, and a portion of the one end closure structure.

16. A carton comprising top and bottom opposed walls interconnected by a pair of side walls to form a tubular body for accommodating a plurality of articles; a pair of end closure structures for at least partially closing opposite ends of the tubular body; and an article dispenser provided by a first removable portion of the carton defined by an endless tear line, the endless tear line comprising:

a first portion formed in the top wall and extending between an end edge of the top wall and a side edge of the top wall;

a second portion formed in one of the side walls and extending from the side edge of the top wall to an end edge of the side wall; and a third portion formed in one of the end closure structures and extending between the end edge of the top wall and the end edge of the side wall, wherein the one end closure structure comprises a top end flap hingedly connected to the end edge of the top wall and a side end flap hingedly connected to the end edge of the one side wall, the top end flap extending downwardly from the top wall, the side end flap extending from the one side wall toward the other side wall, and the third portion of the endless tear line comprises a first sub-portion and a second sub-portion, the first sub-portion being formed in the top end flap, the second sub-portion being formed in the side end flap, wherein the first removable portion is provided by a portion of the top wall, a portion of the one side wall and a portion of the one end closure structure, the top end flap extending downwardly from the top wall, the side end flap extending from the one side wall toward the other side wall, and the portion of the one end closure structure comprises a portion of the top end flap and a portion of the side end flap, wherein the one end closure structure further comprises a bottom end flap hingedly connected to an end edge of the bottom wall, the bottom end flap extending upwardly from the bottom wall, and the portion of the one end closure structure further comprises a portion of the bottom end flap.

17. A package comprising a carton and a plurality of substantially similar, cylindrical articles contained in the carton, the carton comprising a series of panels for forming the carton walls and a first removable portion formed at an end of the carton for facilitating removal of the articles, the first removable portion comprising respective parts of only three adjacent walls of the carton including a top wall, an end wall and a side wall, the top wall being disposed along ends of the cylindrical articles, the first removable portion being defined by an endless tear line disposed in the three adjacent walls, the size of the first removable portion along a first edge between the top and end walls being greater than the diameter of each of the cylindrical articles and being less than twice the diameter of each of the cylindrical articles such that the cylindrical articles are removable one by one from the carton once the first removable portion is removed from the carton, the size of the first removable portion along a second edge between the end and side walls being less than the length of each of the cylindrical articles.

18. The package of claim 17 wherein the tear line comprises a linear portion about which the first removable portion can hinge.

19. The package of claim 17 wherein the first removable portion comprises a tear initiation tab provided to initiate access to the first removable portion and to facilitate progressive separation of the first removable portion from the initiation tab toward said linear portion.

20. The package of claim 17 wherein when the first removable portion is removed from the carton, remaining parts of the top, end and side walls provide sufficient retention of the articles such that the opened carton may be oriented in a first position wherein the articles are upright or in a second position wherein the articles lay on sides thereof whilst preventing accidental egress of the articles and at the same time allowing an end most article to be withdrawn from the carton.

21. The package of claim 17 wherein the carton comprises two compartments for containing articles, said compartments being separated by a divider panel disposed internally of the carton and wherein the first removable portion is formed to provide access to one of the compartments.

22. The package of claim 21, further comprising a second removable portion disposed adjacent said first removable portion, the second removable portion being formed to provide access to the other of the compartments, wherein the first and second removable portions are defined at least in part by a common tear line.

23. The package of claim 17 wherein the size of the first removable portion along the second edge is no less than half the length of the second edge.

24. The package of claim 17 wherein the end wall comprises a top end flap hingedly connected to an end edge of the top wall and a side end flap hingedly connected to the end edge of the one side wall, the top end flap extending downwardly from the top wall, the side end flap extending from the one side wall toward the other side wall, wherein the endless tear line comprises an end wall portion disposed in the end wall and extending between the end edge of the top wall and the end edge of the side wall.

25. The package of claim 24 wherein the end wall portion of the endless tear line comprises a first sub-portion disposed in the top end flap and a second sub-portion disposed in the side end flap.

26. The package of claim 25 wherein the first sub-portion extends front the end edge of the top wall to a side edge of the top end flap, and the second sub-portion extends from the end edge of the side wall to a distal edge of the side end flap.

* * * * *